United States Patent [19]

Parlante et al.

[11] 4,094,450

[45] June 13, 1978

[54] OPEN-TOP HOLSTER FOR REVOLVER

[75] Inventors: Frank Parlante, Brooklyn; Henry Parlante, Bayside, both of N.Y.

[73] Assignee: Courtlandt Boot Jack Co., Ltd., New York, N.Y.

[21] Appl. No.: 763,096

[22] Filed: Jan. 27, 1977

[51] Int. Cl.[2] ..... F41B 13/04

[52] U.S. Cl. ..... 224/2 B; 224/26 B

[58] Field of Search ..... 224/2 B, 2 C, 2 D, 26 R, 224/26 B, 2 R, 5 B, 13

[56] References Cited

U.S. PATENT DOCUMENTS

| | | | |
|---|---|---|---|
| 1,851,352 | 3/1932 | Denkert | 224/2 B |
| 2,391,574 | 12/1945 | Housinger | 224/2 D X |
| 2,527,710 | 10/1950 | Davidson | 224/2 D X |
| 3,420,420 | 1/1969 | Clark | 224/2 B |

*Primary Examiner*—Trygve M. Blix
*Assistant Examiner*—Kenneth Noland
*Attorney, Agent, or Firm*—Michael Ebert

[57] ABSTRACT

An open-top holster for a revolver which affords maximum security for the gun and yet facilitates rapid withdrawal, but only by the wearer of the holster. The holster is strapped to the side of the wearer and includes a pocket socketing the barrel, the trigger assembly and the cylinder of the revolver, the grip being exposed above the pocket. Installed in the pocket is a catch piece formed from a resilient plastic plate having a sector which normally bulges out and intercepts the upper end of the cylinder when the revolver is fully inserted in the holster to prevent its unauthorized withdrawal. The sector is depressible, and in the course of revolver insertion, it is forced against the inner surface of the pocket of the cylinder to permit its full entry, at which point the sector springs out to intercept the upper end of the cylinder. The only way the gun can be drawn is for the wearer of the holster to depress the sector with the thumb of his gun hand to clear the cylinder.

6 Claims, 8 Drawing Figures

Fig. 3.
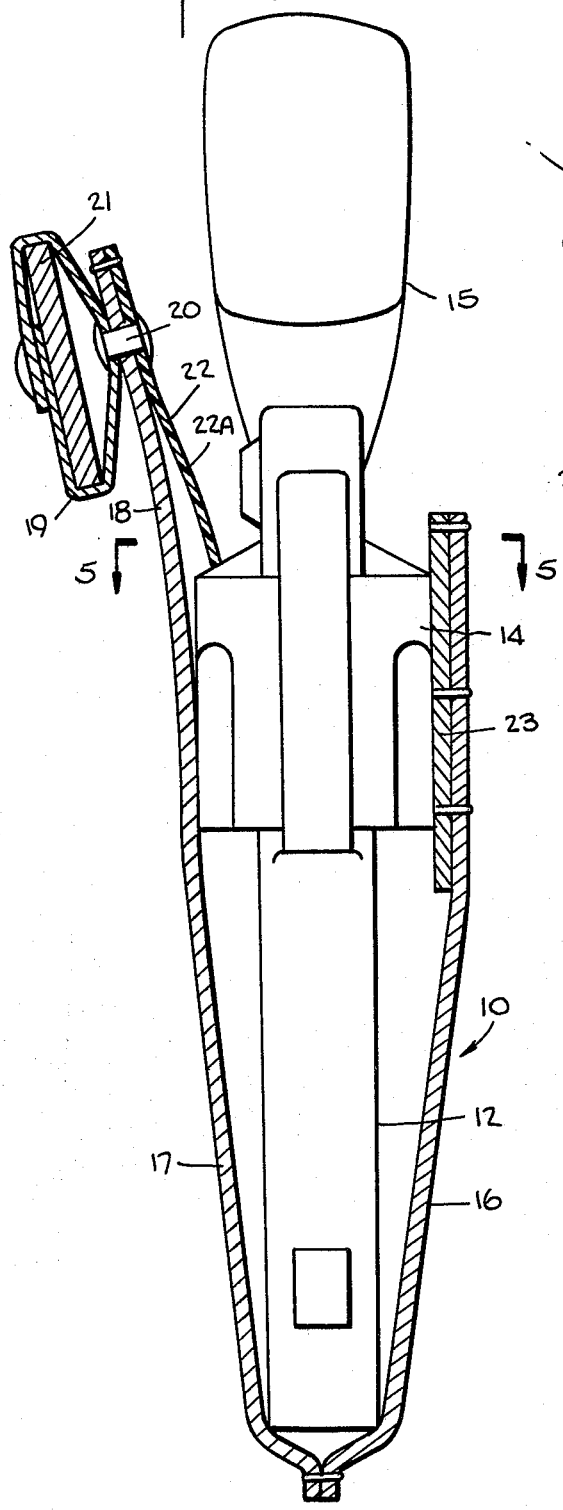
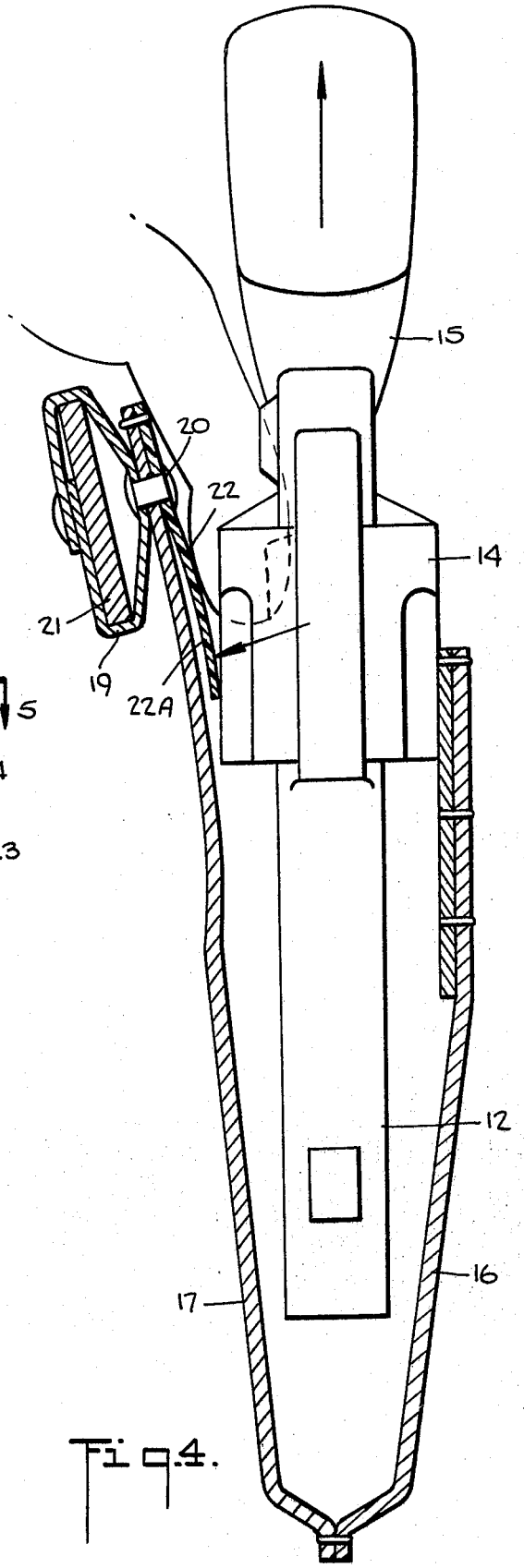
Fig. 4.

OPEN-TOP HOLSTER FOR REVOLVER

BACKGROUND OF THE INVENTION

This invention relates generally to holsters for small arms, and more particularly to an open-top holster for a revolver which though it exposes the grip of the gun, prevents accidental or unauthorized withdrawal thereof.

A holster is a leather case for a handgun that more or less conforms to the shape of the weapon. The design of a holster must take into account two basic requirements which to some extent are incompatible. The first is security; for it is vital that the gun be safely held in the holster so that it remains therein, even though the wearer is active. Moreover, it is important for the holster to prevent accidental or malicious removal of the weapon therefrom.

The second requirement for a holster is that it facilitate quick withdrawal of the weapon. This requirement is equal in importance to the first; for while it is essential that the gun be fully secured within the holster, when the need arises to put the gun in action, one must be able to release the gun and to draw it from the holster without difficulty in the shortest possible time.

The present invention is concerned with a holster for a revolver of the type used, for example, by police officers. A revolver is a handgun having a cylinder with a circular array of chambers for receiving cartridges, the cylinder being brought successively into line with the barrel and discharged with the same hammer.

In an open-top holster for a revolver, the configuration is such that the barrel, the trigger assembly and the cylinder are socketed in the holster, whereas the grip is exposed so that the weapon may be quickly withdrawn. To secure the gun in the holster, it is known to provide a safety strap which overlies the pocket of the holster and is snapped to one side thereof, so that to release the gun one has to uncouple the strap. The objection to this form of security is that the snap button of the safety strap may be accidentally dislodged when the wearer brushes against a wall or other surface, or it may be deliberately and maliciously released by one seeking to gain access to the gun.

Another known form of safety is to provide a leather ridge within the holster which is so positioned that when the revolver is inserted therein, the ridge overlies the upper end of the cylinder and thereby prevents withdrawal of the gun. In order to release the gun, it is necessary for the wearer of the holster to press hard against the leather ridge with his thumb and thereby free the cylinder therefrom to permit withdrawal. The drawback to this known arrangement is that with repeated withdrawal, the leather ridge becomes worn and frayed and, in time, less effective and reliable in operation.

SUMMARY OF INVENTION

In view of the foregoing, it is the main object of this invention to provide an open-top holster for a revolver that affords a high measure of security and yet facilitates a rapid draw.

More particularly, it is an object of the invention to provide a holster of the above-type which includes a catch piece that acts to prevent accidental or malicious withdrawal of the weapon and which functions reliably and effectively for the full life of the holster. Indeed, a catch piece in accordance with the invention may well outlast the holster.

Also an object of the invention is to provide a reinforced leather holster for a revolver which though of simple design has high strength, making the holster suitable for long term, heavy-duty use.

Still another object of this invention is to provide an efficient and reliable holster of the above-type which may be manufactured and sold at relatively low cost.

Briefly stated, these objects are attained in an open-top holster which is strapped to the side of a wearer and is constituted by a pocket shaped to accommodate the barrel, the trigger assembly and the cylinder of a revolver whose grip extends above the pocket and is exposed to facilitate a quick draw.

The side of the pocket which is adjacent the wearer is provided with an integral tongue extending above the cylinder. Marginally secured to the tongue and conforming to the profile thereof is a catch piece formed of a molded plate of resilient synthetic plastic material. The lower straight-edged portion of the plate projects into the pocket and includes a free sector which normally bulges away from the inner surface of the pocket whereby when the revolver is fully inserted in the pocket, the sector intercepts the upper end of the cylinder to prevent unauthorized withdrawal.

The free sector is depressible, and in the course of revolver insertion in the pocket, the sector is forced by the cylinder against the inner surface of the pocket to permit cylinder entry therein. When the cylinder is fully entered, the sector automatically springs out to resume its normal shape and to intercept the upper end of the cylinder.

To draw the gun, the wearer of the holster—who is the only one in a position to do so—must first depress the sector with the thumb of his gun hand to clear the cylinder and thereby permit withdrawal.

OUTLINE OF DRAWINGS

For a better understanding of the invention as well as other objects and further features thereof, reference is made to the following detailed description to be read in conjunction with the accompanying drawings, wherein:

FIG. 3 is a longitudinal section taken in the plane indicated by lines 3—3 in FIG. 1;

FIG. 4 is the same longitudinal section, but showing the manner in which the thumb acts to release the catch piece to permit withdrawal of the gun;

DESCRIPTION OF INVENTION

Figure 1:
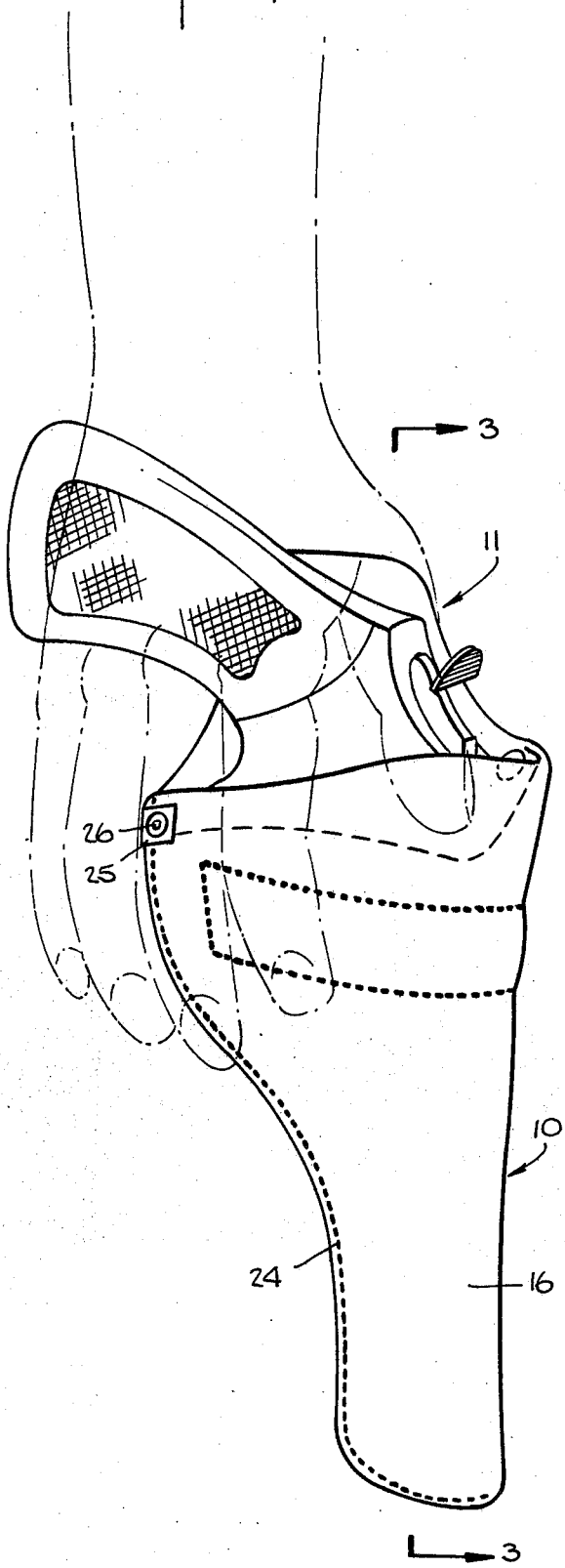
FIG. 1 shows in elevation an open-top holster in accordance with the invention, with a revolver fully inserted therein, the gun hand of the wearer of the holster being placed on the gun with the thumb inserted into the holster to release the catch piece therein to permit withdrawal of the gun.
Figure 2:
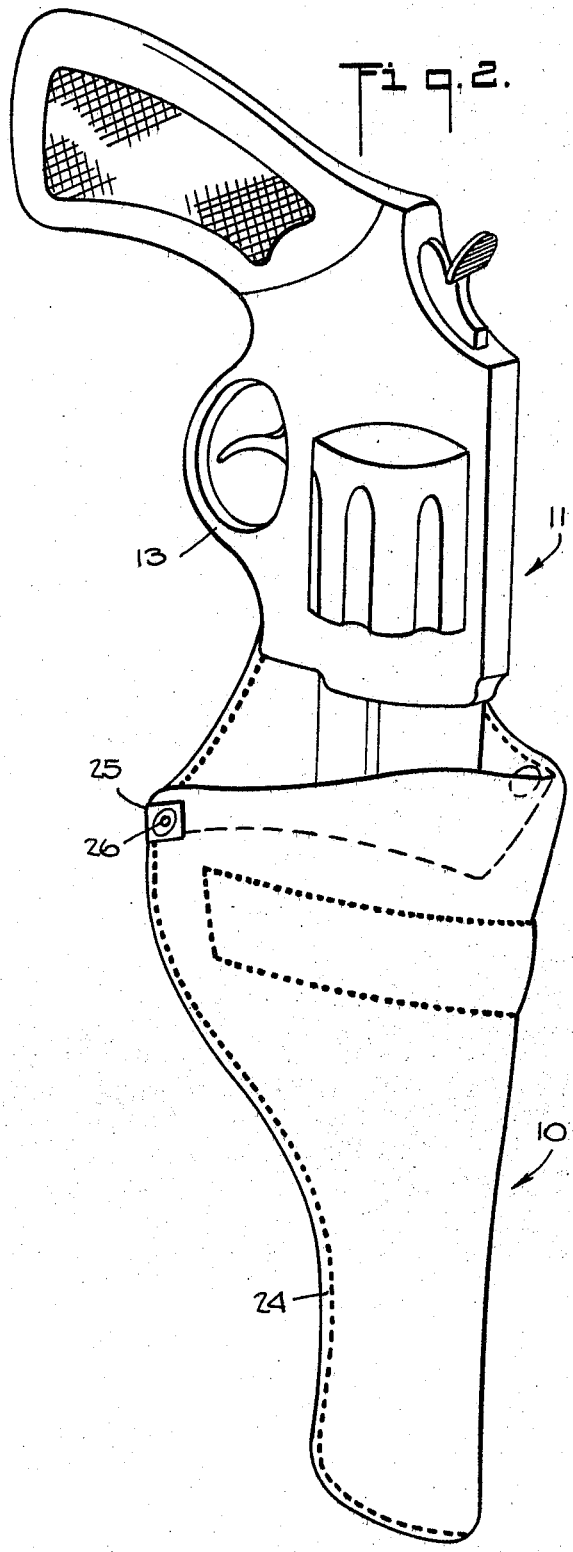
FIG. 2 shows the same holster with the gun in the process of being withdrawn.
Figure 8:
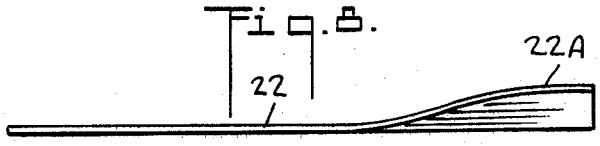
FIG. 8 is a view of the catch piece as seen looking toward its lower edge.

Referring now to FIGS. 1 to 4, there is shown a holster in accordance with the invention, generally designated by numeral 10, designed for a standard revolver 11. The revolver includes a barrel 12, a trigger assembly 13, a cylinder 14 and a grip 15.

Holster 10, which is preferably fabricated of leather, is constituted by a pocket formed by a front wall 16 and a rear wall 17, the rear wall being adjacent the wearer. Rear wall 17 is provided with an integral tongue 18 which extends above the wall and has a loop 19 attached thereto by a rivet 20, the loop serving to receive the wearer's belt 21.

Marginally secured to tongue 18 by stitching or other means is a catch piece 22 of resilient, synthetic plastic material whose profile conforms to the profile of the tongue. The lower portion of catch piece 22 has a straight edge and includes a free sector 22A that normally bulges away from the inner surface of the rear wall 17, as shown in FIG. 3, thereby intercepting the upper end of cylinder 14 to prevent removal of the revolver inserted in the holster.

Figure 6:
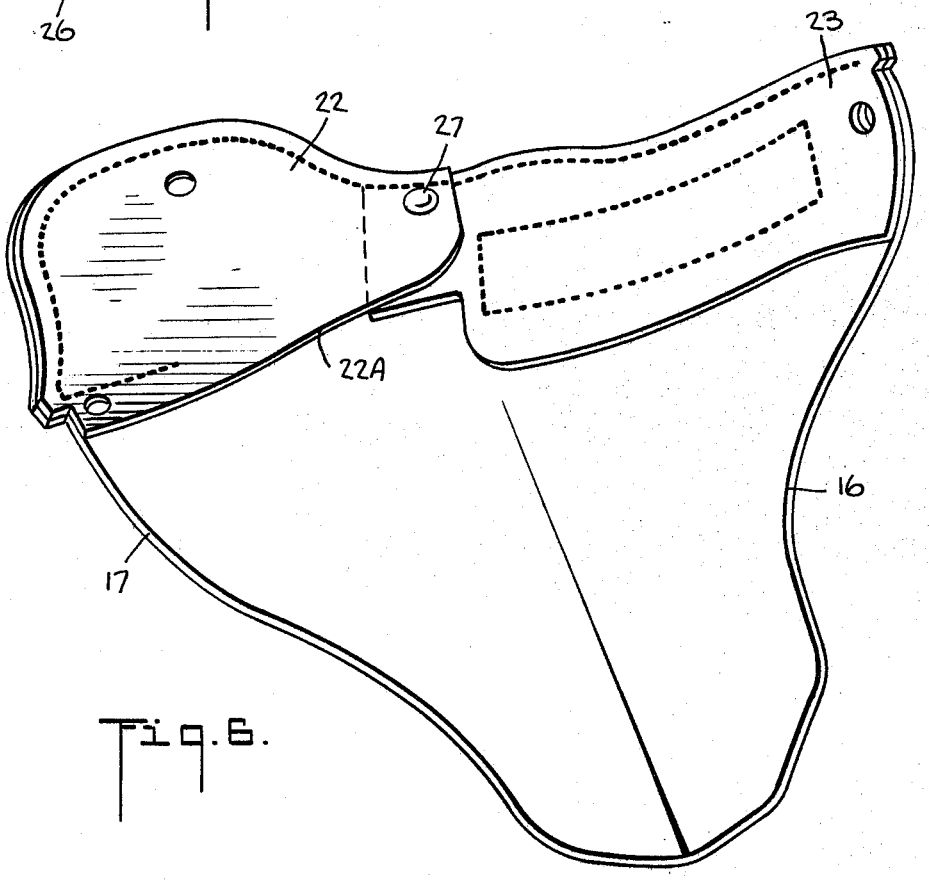
FIG. 6 shows the blank from which the holster is made.

The holster, as shown in FIG. 6, is fabricated from a single blank of leather or synthetic material having similar properties and is profiled to define walls 16 and 17. The shape of the walls is such that when wall 16 is folded over wall 17 and marginally stitched thereto, a holster pocket is formed having a nose portion for socketing barrel 12 of the revolver and a mouth portion for accommodating the cylinder 14 and trigger assembly 13. The upper portion of front wall 16 is reinforced by a leather patch 23 which is stitched thereto, whereas the catch plate 22 is marginally stitched to the tongue extension 18 of rear wall 17, with the sector 22 left free so that it bulges away from the wall surface.

Figure 5:
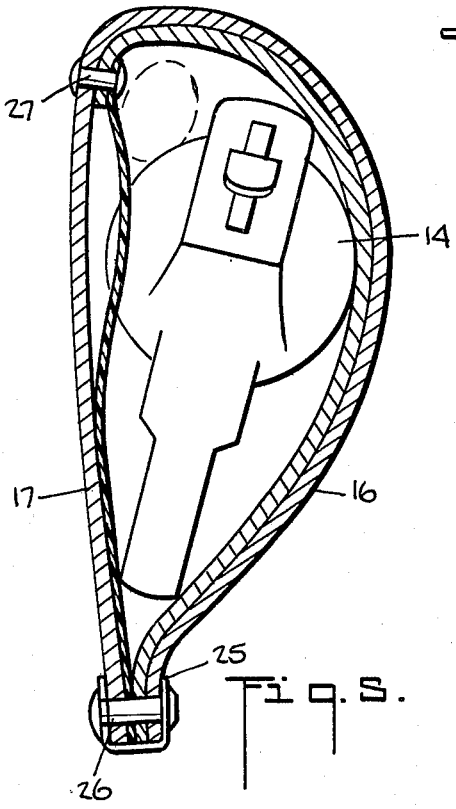
FIG. 5 is a transverse section taken in the plane indicated by line 5—5 in FIG. 3.
Figure 7:
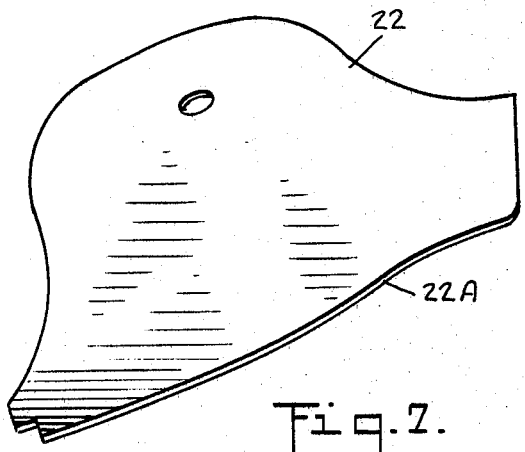
FIG. 7 is a front view of the catch piece.

In use, repeated insertions and withdrawals of the weapon causes the greatest stresses to be imposed on stitching 24 (see FIG. 1) which joins the margins of holster walls 16 and 17. Hence this connection is reinforced by a U-shaped metal clip 25 at the upper end of the pocket. The clip is held in place by a removable bolt 26 as best seen in FIG. 5. In addition to marginal stitching, catch piece 22 is secured to the wall of the pocket by a rivet 27 which also goes through the reinforcing patch 23, the rivet being placed adjacent the upper margin of the pocket to prevent interference with free sector 22A.

Inasmuch as holster security depends on the physical and functional characteristics of catch plate 22, the strength of this plate and its "memory" is of great importance; for not only must this plate be capable of withstanding the wear resulting from frequent insertions and withdrawals of the weapon, but it must also be capable, with repeated depression of the sector to clear the cylinder and to revert back to its normal form. Thus the catch plate must have a persistent memory of its normal molded form and it must never when the free sector 22A is released, fail to return to a position intercepting cylinder 14.

To satisfy these stringent requirements, the catch plate is preferably made of polycarbonate material such as LEXAN, which is a synthetic resin produced by reacting bispenol A and phosgene, a linear polyester of carbonic acid. This material has high impact strength, it is heat resistant and dimensionally stable, and it is easly fabricated to assume a desired shape by thermoforming. Thus to make the catch plate, a sheet of LEXAN of the desired thickness is die cut to form a flat plate of the proper contour, and the plate is then subjected to heat and pressure in a suitable press to form the bulging sector.

When the holster is strapped to the wearer with rear wall 17 against the wearer, the revolver may without difficulty be thrust into the pocket. This causes cylinder 14, as it enters the pocket, to depress sector 22 of the catch piece against the inner surface of wall 17 until the upper end of the cylinder falls below the lower edge of the sector, at which point the sector automatically springs out to intercept the upper end of the cylinder and thereby prevent withdrawal of the inserted revolver, regardless of how active the wearer is. Should a person other than the wearer attempt to draw the gun from the holster, he will find it impossible to do so, for the catch piece has sufficient stiffness and strength to prevent lifting or tearing of the sector.

When the wearer wishes to rleease the catch piece to draw the revolver, he places the thumb of his gun hand, as shown in FIG. 1, into the pocket and depresses the sector to clear the cylinder, and then withdraws the revolver. This can be done quickly and without searching for the sector, for the thumb will sense the bulge of the sector and know just where to press.

While there has been shown and described a preferred embodiment of open-top holster for revolver in accordance with the invention, it will be appreciated that many changes and modifications may be made therein without, however, departing from the essential spirit thereof.

We claim:

1. An open-top revolver holster to be strapped to the side of a wearer and so securing the revolver in the holster that only the wearer can withdraw it with his gun hand, said revolver having a barrel, a trigger assembly, a cylinder and a grip, the holster comprising:

A. a pocket defined by a rear wall adjacent the wearer and a complementary front wall, said rear wall having a tongue extending upwardly from the pocket, said pocket being shaped to socket the barrel as well as the trigger assembly and the cylinder of the revolver, the grip of the revolver being exposed above the pocket; and B. a catch plate formed of resilient synthetic plastic material whose profile conforms to that of the tongue to which it is marginally secured, the lower straight-edged portion of the plate projecting into the pocket and including a free depressible sector which normally bulges away from the inner surface of the pocket, the sector being so positioned that when the revolver is being inserted the cylinder depresses the sector to admit the revolver into the pocket, and when the revolver is fully inserted the edge of the sector springs out to intercept the upper end of the cylinder to prevent unauthorized withdrawal of the revolver, said sector having a memory whereby for the wearer to draw the gun he must first depress the sector to clear the cylinder, the sector when released always reverting to its normal bulge, said plate being molded of thermoplastic polycarbonate material which has high impact strength and is dimensionally stable and has a persistent memory.

2. A holster as set forth in claim 1, wherein said pocket is formed from a single blank of leather which is cut to define said front and rear walls and said tongue.

3. A holster as set forth in claim 2, wherein said front wall is folded over said rear wall and marginally stitched thereto to provide a connection therewith.

4. A holster as set forth in claim 3, wherein said connection is reinforced by a clip embracing said walls and bolted thereto.

5. A holster as set forth in claim 3, wherein the upper portion of said wall is reinforced by a leather patch stitched thereto.

6. A holster as set forth in claim 5, wherein said catch plate is riveted to said leather piece near the junction of said walls.

* * * * *